US006126014A

United States Patent [19]

Gray et al.

[11] Patent Number: 6,126,014

[45] Date of Patent: Oct. 3, 2000

[54] CONTINUOUS AIR AGGLOMERATION METHOD FOR HIGH CARBON FLY ASH BENEFICIATION

[75] Inventors: McMahon L. Gray, Pittsburgh; Kenneth J. Champagne, Monongahela; Dennis H. Finseth, Pittsburgh, all of Pa.

[73] Assignee: The United States of America as represented by the Department of Energy, Washington, D.C.

[21] Appl. No.: 09/161,673

[22] Filed: Sep. 29, 1998

[51] Int. Cl.[7] ..... B03B 5/30; B03B 5/36; B03B 5/44; B03B 1/00

[52] U.S. Cl. ..... 209/163; 209/164; 209/2; 209/5; 209/9; 209/171; 209/173; 241/1; 241/172

[58] Field of Search ..... 209/2, 5, 171, 209/164, 166, 163, 9, 172; 241/1; 106/DIG. 1

[56] References Cited

U.S. PATENT DOCUMENTS

| | | |
|---|---|---|
| 3,147,093 | 9/1964 | Dille et al. . |
| 3,148,140 | 9/1964 | Kaiser et al. . |
| 3,349,029 | 10/1967 | Cheng . |
| 3,770,213 | 11/1973 | Lynn et al. . |
| 3,917,569 | 11/1975 | Richter et al. . |
| 4,014,786 | 3/1977 | Potter et al. . |
| 4,121,945 | 10/1978 | Hurst et al. . |
| 4,141,695 | 2/1979 | Marion et al. . |
| 4,426,282 | 1/1984 | Aunsholt . |
| 4,484,928 | 11/1984 | Keller . |
| 4,588,418 | 5/1986 | Gabler et al. . |
| 5,035,721 | 7/1991 | Atherton . |
| 5,047,145 | 9/1991 | Hwang . |
| 5,227,047 | 7/1993 | Hwang . |
| 5,456,363 | 10/1995 | Groppo et al. . |
| 5,840,179 | 11/1998 | Minkara et al. . |

*Primary Examiner*—Thomas M. Lithgow
*Attorney, Agent, or Firm*—Bradley W. Smith; Mark P. Dvorscak; William R. Moser

[57] ABSTRACT

The carbon and mineral components of fly ash are effectively separated by a continuous air agglomeration method, resulting in a substantially carbon-free mineral stream and a highly concentrated carbon product. The method involves mixing the fly ash comprised of carbon and inorganic mineral matter with a liquid hydrocarbon to form a slurry, contacting the slurry with an aqueous solution, dispersing the hydrocarbon slurry into small droplets within the aqueous solution by mechanical mixing and/or aeration, concentrating the inorganic mineral matter in the aqueous solution, agglomerating the carbon and hydrocarbon in the form of droplets, collecting the droplets, separating the hydrocarbon from the concentrated carbon product, and recycling the hydrocarbon.

15 Claims, 1 Drawing Sheet

CONTINUOUS AIR AGGLOMERATION METHOD FOR HIGH CARBON FLY ASH BENEFICIATION

CONTRACTUAL ORIGIN OF THE INVENTION

The United States Government has rights in this invention pursuant to the employer-employee relationship of the U.S. Department of Energy and the inventor(s).

TECHNICAL FIELD

The present invention relates to a method for reducing the carbon content in fly ash, and, in particular, a continuous air agglomeration process for recovering a concentrated carbon product from fly ash.

BACKGROUND OF INVENTION

The present invention is a continuous, economical, and efficient method for separating carbon from fly ash, such that the remaining fly ash composed generally of mineral matter is suitable for use in applications including the manufacture of cement, and a concentrated carbon product is recovered.

Fly ash is a by-product from the combustion of pulverized coal and is comprised of organic and inorganic fine ash particles. The combustion process fundamentally transforms the organic and inorganic material of the coal and produces fly ash having unique physical properties and a chemical composition very distinct from the coal starting material. For example, coal combustion does not simply concentrate the inorganic mineral matter by burning off carbon, but rather changes the inorganic mineral matter into a new material comprising fused beads of inorganic ash, while liberating soluble ions not present in the original inorganic coal phase. The large quantities of soluble ions present in fly ash, e.g., sodium and calcium, dramatically influence the chemistry of fly ash in aqueous solutions. The high temperatures of coal combustion also burn away volatile materials, in addition to a substantial amount of carbon, present within the coal, leaving a more stable organic char comprised of cross-linked carbon material having a highly graphitic structure not present in coal. The char (organic) phase in fly ash is significantly different from the organic material in coal, as the char has a larger surface area, higher aromaticness, and a lower hydrogen content. Fly ash, therefore, has a physical structure, chemical composition, aqueous solubility, and surface reactivity that is distinct from coal.

Fly ash is currently generated in very large quantities from coal combustion in power plants (millions of tons a year in the U.S.). In the past, the generated fly ash had a low carbon content of less than 6 wt % and was therefore suitable as a partial cement replacement and/or mineral additive in cement. Although the majority of/fly ash is deposited in landfills, the use of fly ash in cement production alleviates expensive waste disposal problems and beneficially increases the quality of the cement product, adding strength and increasing sulfate resistance, while contributing to a more economical cement production process. Recent clean air regulations, however, require electric utility power plants to reduce nitrogen oxide (NOx) emissions, and low NOx burners have the unfortunate side effect of generating fly ash having an unburned carbon content of between 6 wt % to 25 wt %, unacceptably high for cement production. To convert high carbon fly ash into a useful by-product, the carbon content must be reduced. In addition to generating a useful low carbon fly ash, it would further be advantageous for methods for reducing the carbon content in fly ash to produce a residual carbon product that may be utilized for recombustion and energy production, or as a catalytic material.

Unsurprisingly, several methods for reducing the carbon content in fly ash have recently been disclosed. Many of these methods are dry processes involving thermal treatments that combust the unburned carbon to produce low carbon fly ash. For example, U.S. Pat. No. 5,749,308 issued to Bachik describes igniting the carbon by a heated oxidizing gas stream in an ignition chamber and transferring the fly ash and ignited carbon to a combustion chamber to accomplish the desired level of carbon burnout. U.S. Pat. No. 5,555,821 issued to Martinez teaches moving the fly ash through a stainless steel heating chamber by a screw auger, which mixes the fly ash with oxygen to burn the unwanted carbon. U.S. Pat. No. 5,390,611 issued to John describes a dry thermal process involving tumble mixing the fly ash through electrically heated pre-heat and combustion chambers. Finally, U.S. Pat. No. 4,663,507 issued to Trerice teaches employing microwave energy to induce combustion of the carbon in the fly ash.

Combusting unburned carbon in fly ash is energy intensive and therefore inherently expensive. Combustion methods are also often very sensitive to the variability in the fly ashes derived from different coal sources and involve large air handling systems that require expensive gas/particulate separators. In addition, combusting the carbon may result in agglomeration of the fly ash, which is undesirable when the fly ash is used for cement production, and any valuable carbon by-product is lost.

U.S. Pat. No. 5,513,755 issued to Heavilon, et al. discloses another dry process, wherein heated fly ash is moved along a belt-type vibrating conveyor through an electrostatic charging zone which causes the carbon particles to become charged and attracted to an electrode for separation from the fly ash. Electrostatic dry particle separation methods have been generally impractical for carbon reduction in fly ash due to the special characteristics of fly ash, including the large quantity of very fine particles which comprise a substantial fraction of the carbon content. U.S. Pat. Nos. 5,339,194 and 5,160,539 issued to Cochran, et al. also discloses a dry process involving oxidation of the carbon in fly ash in dry, bubbling fluid beds at high temperatures. Other dry processes involve classification by particle size, including methods described in U.S. Pat. No. 5,299,692 issued to Nelson, wherein fly ash is subjected to a vibrating inclined surface to disaggregate and stratify a high carbon fraction from the fly ash, and in U.S. Pat. No. 3,769,054 issued to Pennachetti, wherein fly ash is subjected to air classification and screening, among other steps.

Proposed wet processes for separating carbon from fly ash are known to involve froth flotation methods that conventionally separate mineral matter by use of specific reagents and chemical conditions. Froth flotation plants include conditioning tanks and flotation vessels having a series of flotation cells. The use of a flotation liquid, a collector, a frother, and possibly dispersants, activators, and other regulation agents, are necessary. Generally, a chemical reagent is added to the mineral slurry in the conditioning tank to make certain mineral surfaces hydrophobic by absorption, while leaving other mineral surfaces hydrophilic. The slurry is aerated in the flotation vessel, whereby the air bubbles become laden with the hydrophobic particles and rise to the surface. The separated mineral particles are transferred to the next flotation cell until sufficient separation is achieved. Advantageously, the carbon is not consumed as in combustion by the wet process of froth flotation, but recoverable as a valuable by-product.

U.S. Pat. No. 5,456,363 issued to Groppo, et al. describes a method of removing carbon from fly ash by an improved froth flotation method. The method includes producing an aqueous slurry, adding a flotation reagent comprised of a mixture of fuel oil and petroleum sulfonate to make the carbon hydrophobic, aerating the slurry, and recovering the carbon from the upper portion of the flotation apparatus, while withdrawing the fly ash tailings from the lower portion. Similarly, U.S. Pat. Nos. 5,227,047 and 5,047,145 issued to Hwang teach a wet process for fly ash beneficiation, wherein the unburned carbon is separated from a fly ash slurry by adding to the slurry a collector (oil having a carbon chain greater than octane), a dispersant, and a frothing agent, and inducing air into the system for frothing the slurry wherein the hydrophobic unburned carbon froths to the surface and is removed by skimming off the frothing layer.

Froth flotation is a complex process influenced by pH, slurry density, particle size, bubble size, air flow, reagent mixtures, and efficient separation and recovery methods. Inefficiencies associated with froth flotation as applied to carbon separation in fly ash include the use of excessive amounts of reagents required to render carbon particles hydrophobic, lengthy flotation time, and inadequate recovery of a significant amount of the separated material (carbon). These inefficiencies are most probably caused by the unique characteristics of fly ash, including the fineness of the fused beads of material and large surface areas of the carbon particles. Flotation also requires a significant investment in capital equipment and high operating expenses.

In view of the above discussion, there continues to exist a need in the art for an efficient and economic method for reducing the carbon content in fly ash.

The present method is a continuous process for separating carbon from the mineral compositions in fly ash by using an air agglomeration process.

Therefore, in view of the above, a basic object of the present invention is to provide a continuous, cost-effective, and efficient method for reducing the carbon content in fly ash, whereby the fly ash is useful in cement production.

A further object of this invention is to provide a method for recovering a valuable concentrated carbon product from fly ash.

Yet another object of this invention is to provide a method for recovering a concentrated carbon product from fly ash having a high yield, or ratio of recovered carbon to total carbon in the untreated fly ash of greater than 60 wt %.

Yet another object of this invention is to provide a method for recovering a concentrated carbon product from fly ash having a high purity, or ratio of recovered carbon to total recovered material of greater than 60 wt %.

A further object of this invention is to provide a continuous method for recovering a concentrated carbon product from fly ash, whereby the hydrocarbon solvent is recycled into the recovery system.

Additional objects, advantages, and novel features of the invention are set forth in the description which follows and will also become apparent to those skilled in the art upon examination of the following or may be learned by practice of the invention.

BRIEF SUMMARY OF THE INVENTION

The present invention relates to a continuous air agglomeration method for separating carbon from fly ash, resulting in a substantially carbon-free fly ash stream and a highly concentrated carbon product. Advantageously, the agglomerating agent is recyclable. The method involves mixing the fly ash comprised of carbon and inorganic mineral matter with a liquid hydrocarbon to form a slurry, introducing the hydrocarbon slurry containing the fly ash into the bottom of a separation column containing an aqueous solution, dispersing the hydrocarbon slurry into small droplets within the aqueous solution by mechanical mixing and/or aeration, concentrating the inorganic mineral matter in the aqueous solution, agglomerating the carbon and hydrocarbon in the form of droplets, collecting the droplets from the top of the separation column, separating the hydrocarbon from the concentrated carbon product, and recycling the hydrocarbon, whereby the hydrocarbon solvent is mixed with fly ash to form a slurry for introduction into the separation column.

BRIEF DESCRIPTION OF THE DRAWINGS

These and other objects, aspects, and advantages of the present invention will be better understood from the following detailed description of the preferred embodiment of the invention with reference to the drawings, in which.

DETAILED DESCRIPTION OF THE INVENTION

Figure 1:
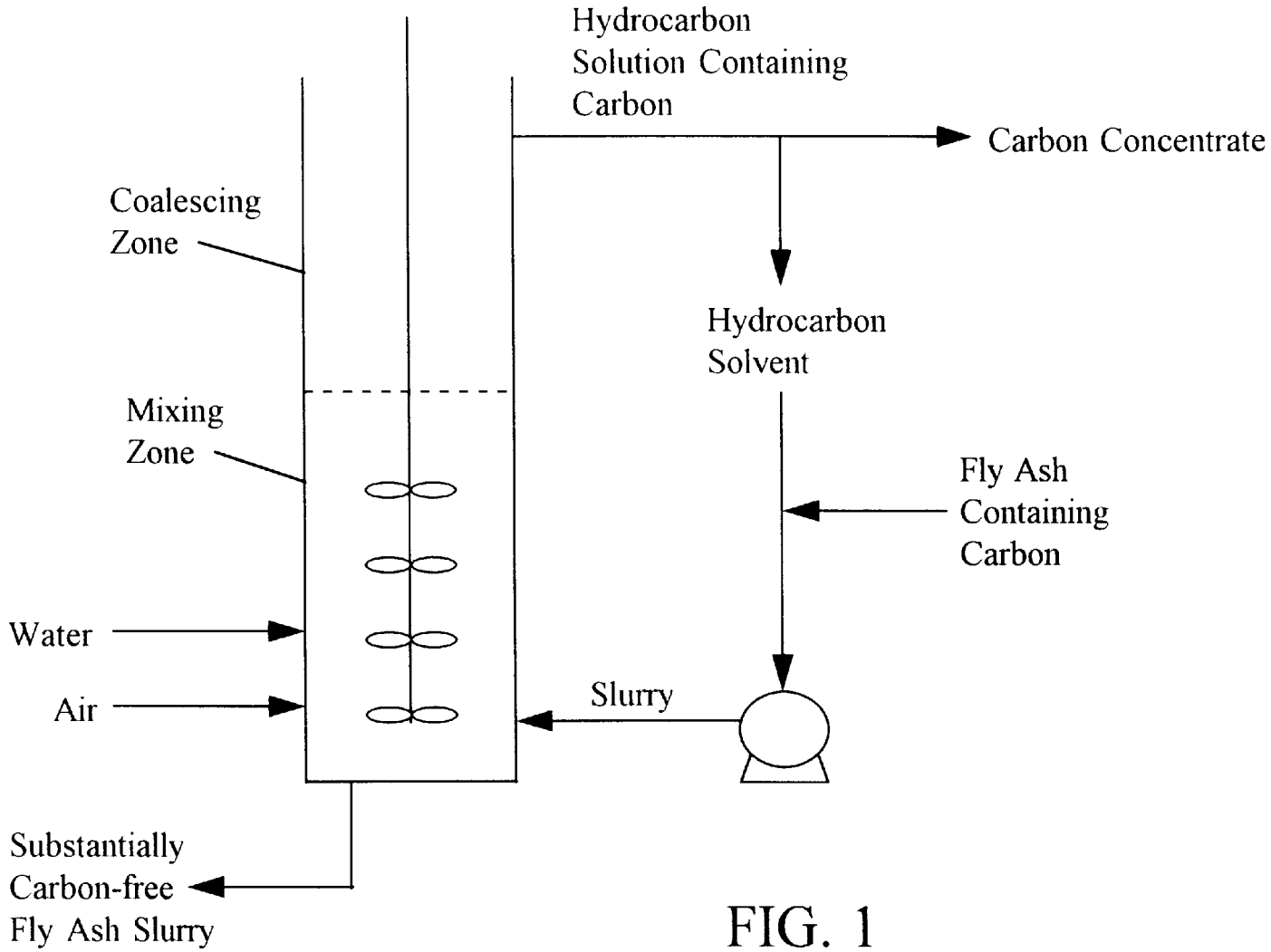
FIG. 1 is a schematic diagram of the air agglomeration method.

The present method for separating carbon from fly ash involves an air agglomeration process that results in a substantially carbon-free fly ash acceptable as a cement additive, a highly concentrated carbon product, and a recyclable agglomerating agent stream. The air agglomeration method is efficient and continuous, overcomes the disadvantages of the above described prior art approaches, including the use of excessive amounts of reagents and lengthy flotation time, and results in a significantly improved carbon yield.

FIG. 1 illustrates the current continuous air agglomeration method for treating fly ash. First, a slurry is formed by mixing fly ash comprised of carbon and inorganic mineral matter with a hydrocarbon solvent having a density less than water. A light molecular weight hydrocarbon is preferred. Preferably, the hydrocarbon solvents are selected from a group comprising of pentane, hexane, heptane, and cyclohexane. Most preferably, the hydrocarbon solvent is cyclohexane. The ash to solvent ratio is preferably in the range of between about 1:2 to about 1:7.

The hydrocarbon slurry containing the fly ash is pumped into the bottom of a separation column containing an aqueous solution. Preferably, the feed rate of the hydrocarbon slurry into the column is in the range of between about 200 to about 1000 ml/min. In the preferred embodiment, the separation column includes a lower mixing zone containing, for example, a rotating agitator or impeller driven by a motor for agitating the column contents, and a higher coalescing zone. Where a rotating agitator is employed, the agitation speed for the turbine blades in a 6 ft separation column is in the range of between about 200 to about 600 rpm. Air bubbles are also introduced into the separation column, preferably at the bottom of the column or by way of air ports in the mixing apparatus (e.g., perforations in the central shaft of the agitator). The air flow rate in the column is preferably between the range of about 0 to 6000 ml/min.

The hydrocarbon slurry is divided into droplets within the aqueous solution by the agitation in the mixing zone. The inorganic mineral matter of the fly ash is hydrophilic and concentrates in the aqueous solution, while the hydrophobic carbon remains in the hydrocarbon droplet. The buoyant forces of the less dense hydrocarbon solvent within the aqueous solution and the air bubbles cause the hydrocarbon droplets to move upwardly in the column out of the mixing zone and into the coalescing zone. The hydrocarbon droplets containing the carbon continue to agglomerate in the coalescing zone and accumulate at the top of the column, where they are removed.

The harvested hydrocarbon droplets containing the carbon are subjected to solid/liquid separation processes known in the art to separate the carbon from the hydrocarbon solvent, and a valuable carbon concentrate is recovered. Preferably, a simple collection collar with a water spray collects the carbon rich agglomerate. Where the solid/liquid separation process involves a water spray, resulting in a secondary stream comprised of the hydrocarbon solvent and water, the hydrocarbon solvent may be recovered for recycling by known liquid/liquid density separation methods. The hydrocarbon solvent is recycled by mixing with fly ash to form the hydrocarbon fly ash slurry for introduction into the separation column. The aqueous solution rich with the inorganic mineral matter and substantially free of carbon is recovered from the base of the column.

In an alternate embodiment, the present air agglomeration method includes the step of treating the fly ash slurry with ultrasonic energy, for example in the range of between about 0.25 MHZ to about 1.0 MHZ, prior to or during the air agglomeration process to improve the purity and yield of the recovered carbon.

EXAMPLE 1

First, bituminous fly ash obtained from the combustion division of the Federal Energy Technology Center in Pittsburgh, Pennsylvania was mixed with the hydrocarbon solvent cyclohexane in an ash to solvent ratio of 1:6. The fly ash had the composition provided in Table I. High carbon fly ash was used, comprising an unburned carbon content of 9.5 wt %.

TABLE I

| Fly Ash Composition in wt % | |
|---|---|
| Ash | 89.56 |
| Hydrogen | 0.47 |
| Carbon | 9.50 |
| Total Sulfur | 0.70 |
| Sulfite in ash | 0.58 |

The separation of the carbon from the fly ash was accomplished by using a 6 ft separation column containing an aqueous solution and having a motorized central shaft with turbine blades extending therefrom for mixing. The fly ash hydrocarbon slurry (comprised of 16 wt % ash) was introduced into the lower section of the column at a feed rate of 930 ml/min. At an agitation speed of 400 rpm, the fly ash slurry contacted the aqueous solution in the mixing zone of the separation column. The unburned carbon particles and cyclohexane solvent formed agglomerates and moved upwardly in the column into the coalescing zone. The unburned carbon/cyclohexane agglomerates were collected at the top of the separation column by using a 60 mesh screen. The cyclohexane solvent was separated from the carbon particles and recovered for recycling into the separation system. The results of this example demonstrate remarkable efficiency for separating carbon from fly ash in accordance with the present method, as listed in Table II below.

TABLE II

| Recovery of Carbon from High Carbon Fly Ash | | |
|---|---|---|
| % Carbon Purity | % Carbon Yield | % Solvent Recovery |
| 69.5 | 64.9 | 80.0 |

EXAMPLE 2

In this example, the same parameters were used as in Example 1, however, air was pumped into the lower section of the column at an air flow rate of 288 ml/min. The increased efficiency of the present carbon separation system by introducing air into the separation column is demonstrated by the results of this example listed in

TABLE III

| Recovery of Carbon from High Carbon Fly Ash | | |
|---|---|---|
| % Carbon Purity | % Carbon Yield | % Solvent Recovery |
| 65.7 | 91.8 | 89.0 |

EXAMPLE 3

Under the same conditions as in Example 1, and without the addition of air into the column, the separation of carbon from the fly ash was tested using two different hydrocarbon solvents, in the place of cyclohexane. As shown by the results provided in Table IV, solvent selection is a critical factor in the performance of this process.

TABLE IV

| Recovery of Unburned Carbon Alternative Hydrocarbon Solvents | | | |
|---|---|---|---|
| Solvent | % Carbon Purity | % Carbon Yield | % Solvent Recovery |
| Hexane | 56.9 | 52.9 | 75.0 |
| Heptane | 41.4 | 56.9 | 77.0 |

EXAMPLE 4

This example demonstrates the effects of agitation speed. The same parameters were used as in Example 2, except that the air flow rate was fixed at 288 ml/min. The agitation was varied from 200 to 600 rpm.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiments described explain the principles of the invention and practical applications and should enable others skilled in the art to utilize the invention in various embodiments and with various modifications as are suited to the particular use contemplated. While the invention has been described with reference to details of the illustrated embodiment, these details are not intended to limit the scope of the invention, rather the scope of the invention is to be defined by the claims appended hereto.

The embodiments of the invention in which an exclusive property or privilege is claimed are defined as follows:

1. A method for recovering a concentrated carbon product from fly ash, comprising the steps of:

mixing fly ash derived from the combustion of coal and comprised primarily of a carbon constituent and an inorganic mineral matter constituent with a hydrocarbon solvent having a density that is less than water and selected from the group consisting of pentane, hexane, heptane, and cyclohexane to form a solvent mixture;

pumping the solvent mixture into a separation column containing an aqueous solution in such a manner that said mixture enters the column at a column base point so that as the less dense mixture rises it will transgress a major portion of the column of aqueous solution;

employing mechanical means to agitate the solvent mixture and the aqueous solution within the separation column to disperse the solvent mixture as droplets within the aqueous solution, whereby the inorganic mineral matter concentrates in the aqueous solution and the carbon constituent agglomerates in the hydrocarbon solvent droplets;

allowing the less dense carbon containing solvent droplets to accumulate at a top portion of the column in a coalescing zone;

removing the carbon containing droplets from the coalescing zone;

recovering the aqueous solution containing the inorganic mineral matter from the lower part of the column;

recovering a concentrated carbon product from the hydrocarbon solvent droplets; and recycling the substantially carbon-free droplets of hydrocarbon solvent to again mix with the fly ash.

2. The method according to claim 1, wherein air bubbles are introduced at the base of the separation column at a flow rate of up to 6,000 ml/min.

3. The method according to claim 1, wherein the step of recovering a concentrated carbon product comprises recovering a carbon product having a carbon concentration in the range of between about 65 wt % to about 75 wt %.

4. The method according to claim 2, wherein the step of recovering a concentrated carbon product comprises recovering a carbon product having a carbon concentration in the range of between about 80 wt % to about 90 wt %.

5. The method according to claim 1, wherein the step of mixing the fly ash with the hydrocarbon solvent comprises mixing the fly ash with the hydrocarbon cyclohexane.

6. The method according to claim 1, further comprising the step of continuously pumping the mixture of fly ash and hydrocarbon solvent into the separation column at a rate of between 200 to 1,000 ml/min.

7. The method according to claim 1, wherein the mechanical means to agitate is a rotating agitator.

8. The method according to claim 2, further comprising the step of applying ultrasonic energy to a solvent-aqueous mixture contained within the separation column during aeration.

9. The method according to claim 1, wherein the step of recovering a concentrated carbon product from the hydrocarbon droplets comprises filtering the hydrocarbon droplets, whereby the carbon remains as a solid product.

10. The method according to claim 1, wherein the step of mixing fly ash with a hydrocarbon solvent comprises mixing fly ash having a carbon content of between about 3 wt % to about 20 wt %.

11. The method according to claim 1, further comprising the step of applying ultrasonic acoustic energy to the solvent mixture prior to pumping the solvent mixture into the separation column.

12. A method for producing substantially carbon-free fly ash and a concentrated carbon product from fly ash containing inorganic mineral matter and carbon, comprising the steps of:

mixing the carbon containing fly ash which is derived from the combustion of coal with cyclohexane to form a slurry;

adding the slurry to an aqueous solution in a separation chamber to form a slurry-aqueous mixture;

mechanically agitating the aqueous solution slurry mixture by means of a rotating agitator, whereby the inorganic mineral matter is dispersed within the aqueous solution and the carbon agglomerates in droplets of cyclohexane;

separating the droplets containing carbon from the aqueous solution containing the inorganic mineral matter;

recovering an aqueous stream of substantially carbon-free fly ash;

recovering a concentrated carbon product from the droplets of an agglomerating agent, cyclohexane; and recycling the agglomerating agent.

13. The method according to claim 12, wherein air bubbles are introduced into the slurry-aqueous solution mixture.

14. The method according to claim 1, wherein air bubbles are introduced into the separation column by means of ports in a mechanical agitation device.

15. The method according to claim 14, further comprising the step of applying ultrasonic energy to a solvent-aqueous mixture contained within the separation column during aeration.

* * * * *